United States Patent [19]

Hansen

[11] Patent Number: 4,664,227

[45] Date of Patent: May 12, 1987

[54] PORTABLE BALUSTRADE AND PLATFORM ASSEMBLY

[76] Inventor: Orville S. Hansen, P.O. Box 156, Hydro, Okla. 73048

[21] Appl. No.: 902,149

[22] Filed: Aug. 29, 1986

[51] Int. Cl.[4] ..... A47C 9/00; E06C 9/00

[52] U.S. Cl. ..... 182/82; 182/92; 182/106; 182/113; 256/65

[58] Field of Search ..... 182/82, 106, 113, 92; 256/65; 52/182

[56] References Cited

U.S. PATENT DOCUMENTS

| | | | |
|---|---|---|---|
| 2,558,142 | 6/1951 | Lapp | 256/65 |
| 2,861,731 | 11/1958 | Robinson | 182/106 |
| 3,043,396 | 7/1962 | Norris | 182/106 |
| 3,207,260 | 9/1965 | Castagna | 182/106 |
| 3,578,110 | 5/1971 | Seagraves | 182/106 |
| 3,693,754 | 9/1972 | Butler | 182/113 |
| 3,743,052 | 7/1973 | Muzer | 182/106 |
| 4,034,829 | 7/1977 | Hoffman | 182/113 |

*Primary Examiner*—Reinaldo P. Machado
*Attorney, Agent, or Firm*—Glen M. Burdick

[57] ABSTRACT

A portable balustrade and platform assembly for a structure, such as a recreational vehicle, is provided for stabilizing and assisting a person entering and exiting the structure via a door thereof. The balustrade and platform assembly, which is detachable from the structure when not in use, or for transportation and storage, comprises: a support bracket connectable to the recreational structure substantially adjacent the door thereof; a step assembly supported on the ground, the step assembly having a substantially horizontally disposed planar supporting surface; a hand rail assembly graspable by the person for stabilizing the person as the person exits and enters the structure via the door thereof to and from the step assembly, the hand rail means having a first end portion and a second end portion, the first end portion connectable to the support bracket such that the second end portion is disposed substantially adjacent the step assembly; and a connector assembly for connecting the second end portion of the hand rail assembly to the step assembly such that the angular and spatial relationship of the hand rail assembly between the support bracket and the step assembly can be established over a range of adjustments including lateral, rotational and vertical adjustments.

21 Claims, 8 Drawing Figures

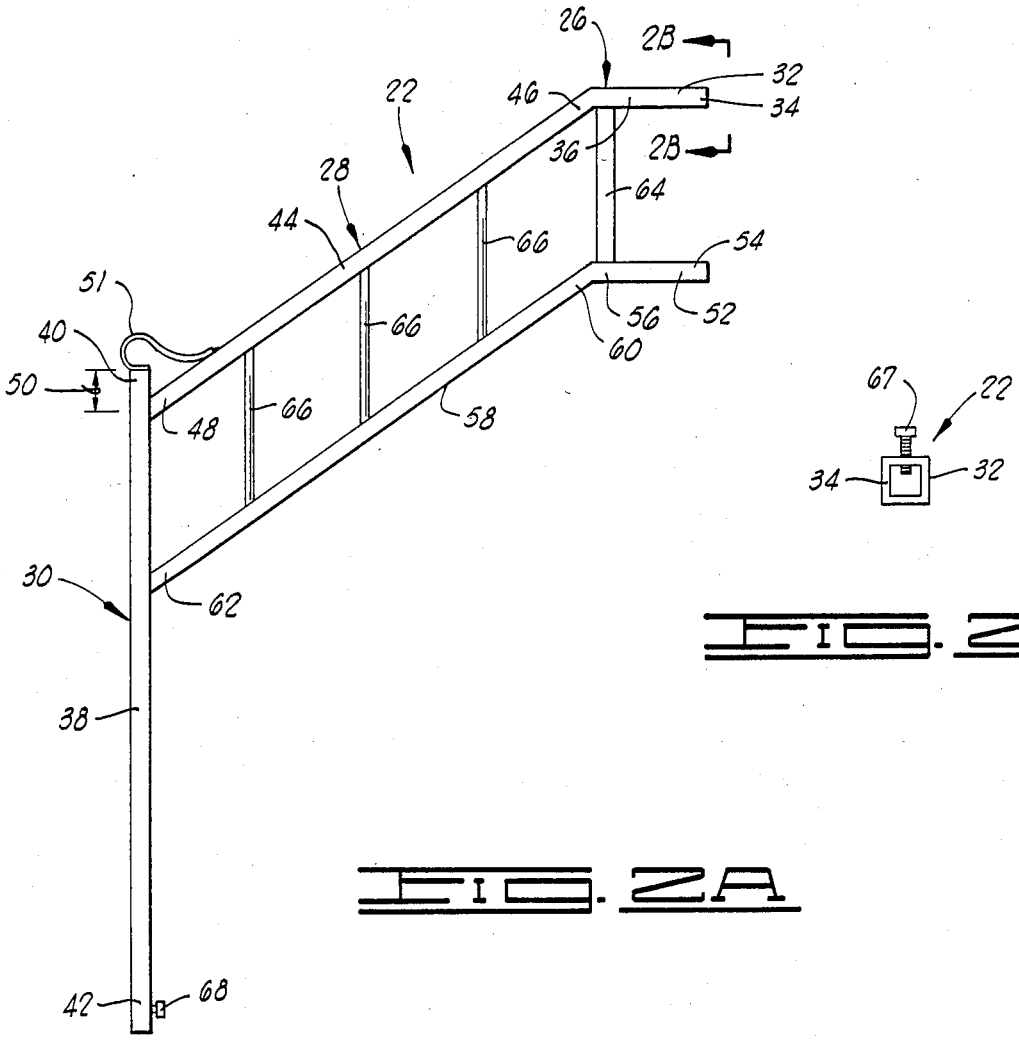
FIG. 2B
FIG. 2A
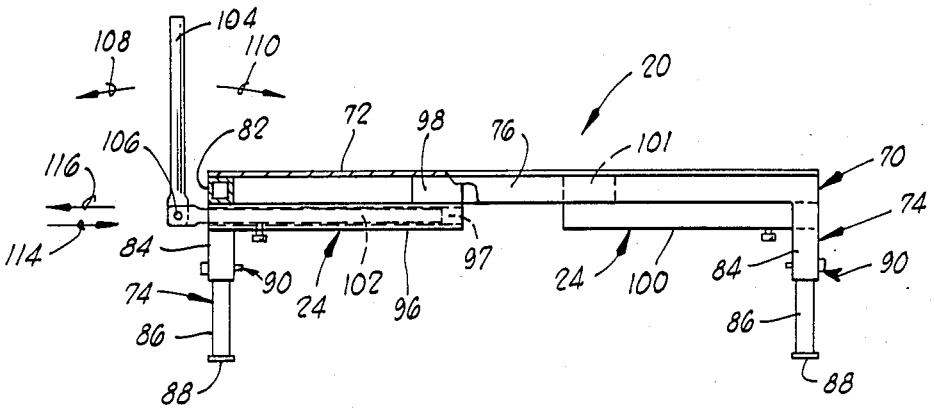
FIG. 3

PORTABLE BALUSTRADE AND PLATFORM ASSEMBLY

BACKGROUND OF THE INVENTION

1. Field of the Invention

The present invention relates generally to building structures, and more particularly, but not by way of limitation, to a portable balustrade and platform assembly for use with a recreational vehicle.

2. Brief Description of the Prior Art

In recent years, recreational vehicles have become increasingly popular for use in travels of elderly and retired persons. However, because recreational vehicles are designed to travel over the roadways, such vehicles are generally provided with a substantially elevated doorway, and one or more retractable steps are provided for entering or exiting the recreational vehicle via the door thereof.

It would be highly desirable to fabricate a balustrade for a recreational vehicle that would assist and stabilize persons entering and exiting the recreational vehicle via the retractable steps. It is to such an assembly that the present invention is directed.

SUMMARY OF THE INVENTION

According to the present invention, a portable balustrade and platform assembly for a structure, such as a recreational vehicle, is provided which is capable of stabilizing and assisting a person when entering and exiting the recreational vehicle via a door thereof. The balustrade and platform assembly, which is detachable from the vehicle when not in use for transportation and storage, comprises: a support bracket connectable to the vehicle substantially adjacent the door thereof; a step assembly supported on the ground so as to have a substantially horizontally disposed planar supporting surface; a hand rail assembly disposed between the support bracket and the step assembly; and, a connector assembly for connecting the hand rail assembly to the step assembly so that the angular and spatial relationship of the hand rail assembly between the support bracket and the step assembly can be established over a range of adjustments including lateral, rotational and vertical adjustments.

Accordingly, an object of the present invention is to provide a portable balustrade and platform assembly for use with a structure, such as a recreational vehicle, and which is graspable by a person for stabilizing the person as the person exits or enters the structure via a door thereof.

Another object of the present invention, while achieving the before stated object, is to provide a portable balustrade and platform assembly for use with a recreational vehicle which can be quickly and easily attached to the vehicle for use, and readily disassembled for transporting and storage.

Another object of the present invention, while achieving the above stated objects, is to provide an inexpensive and effective balustrade and platform assembly for use with a recreational vehicle which is economical to manufacture and durable in construction, and which provides a safe and steady assisting device for persons entering or exiting the recreational vehicle.

Other objects, advantages and features of the present invention will become clear from the following detailed description of the preferred embodiment when read in conjunction with the drawings and the appended claims.

BRIEF DESCRIPTION OF THE DRAWINGS

FIG. 2A is a side elevational view of a hand rail assembly of the balustrade and platform assembly of FIG. 1.

FIG. 2B is an end view of the hand rail assembly of FIG. 2A taken along the the line 2B—2B, and illustrating a bolt for connecting the hand rail assembly to a connector assembly.

FIG. 3 is a partial cutaway, side elevational view of a platform assembly and illustrating a connector assembly for connecting the platform assembly to the hand rail assembly.

DESCRIPTION

Figure 1:
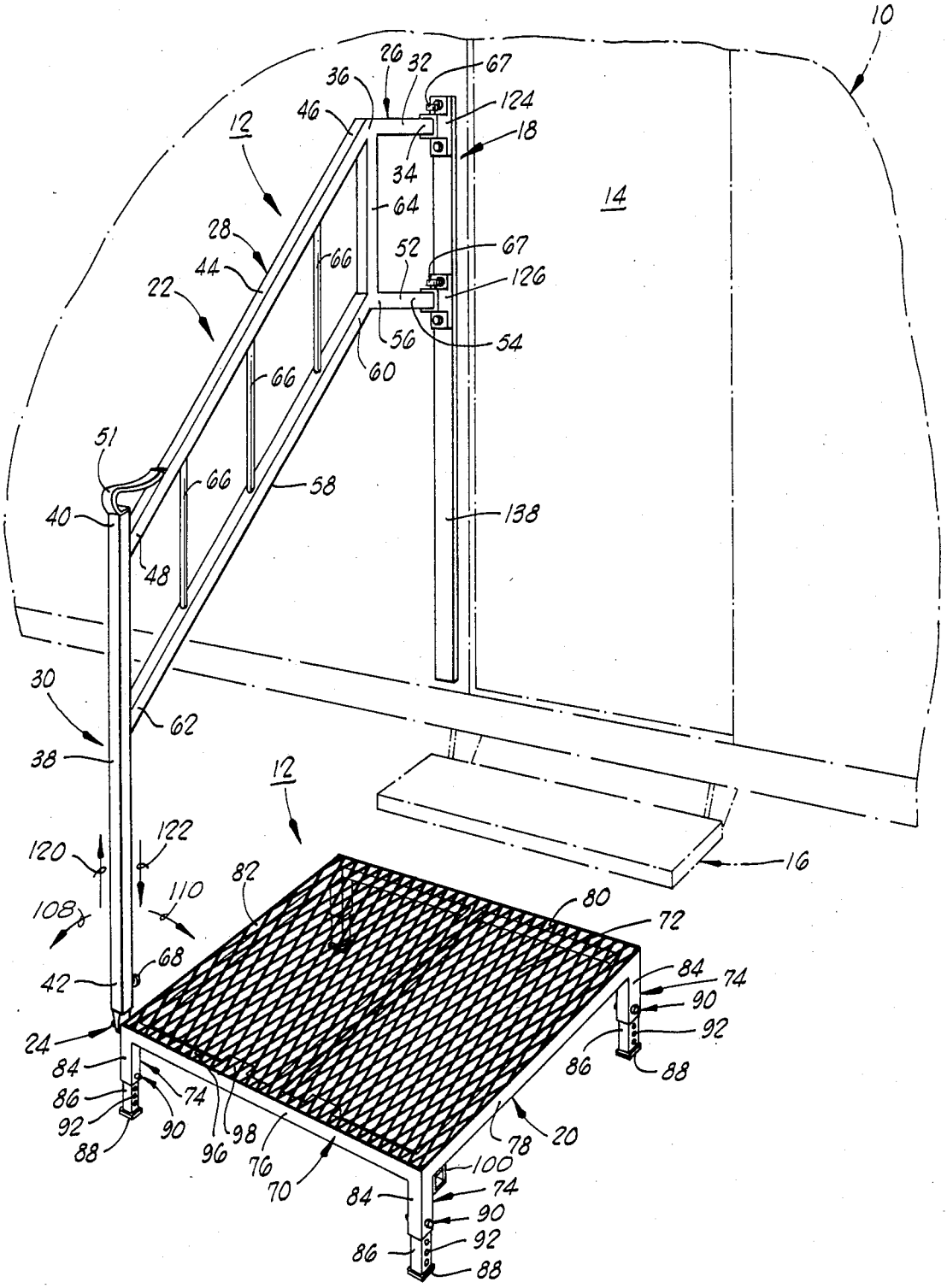
FIG. 1 is a perspective view of a portable balustrade and platform assembly of the present invention connected to a structure, such as recreational vehicle, shown by phantom lines.

Referring to the drawings generally, and particularly to FIG. 1, shown therein by phantom lines is a portion of a structure, such as a recreational vehicle 10, having a balustrade and platform assembly 12 connected thereto. The balustrade and platform assembly 12 can be readily connected to the recreational vehicle 10, as illustrated, or the balustrade and platform assembly 12 can be disconnected from the recreational vehicle 10 and disassembled for storage and transporting. When connected to the recreational vehicle 10, the balustrade and platform assembly 12 stabilizes and assists a person entering and exiting the recreational vehicle 10 via a door 14 and retractable steps attached the recreational vehicle 10, such as steps 16. The recreational vehicle 10 and the steps 16 are of conventional construction, so no further comments are deemed necessary concerning the recreational vehicle 10 in order to enable one to fully understand the balustrade and platform assembly 12 of the present invention.

The balustrade and platform assembly 12 comprises a support bracket assembly 18 connectable to the recreational vehicle 10 substantially adjacent to the door 14 thereof; a step assembly 20 disposable at a predetermined height above the foundation or supporting surface of the recreational vehicle 10 so as to be substantially below the door 14; a hand rail assembly 22 disposed between the support bracket assembly 18 and the step assembly 20; and a connector assembly 24 for connecting the hand rail assembly 22 to the step assembly 20 such that the angular and spatial relationship of the hand rail assembly 22 can be established over a range of adjustments including lateral, rotation and vertical adjustments.

Referring now to FIGS. 1, 2A and 2B, the hand rail assembly 22 comprises a first end portion 26, an angularly disposed medial portion 28, and a second end portion 30. The first end portion 26 of the hand rail assembly 22 is connectable to the recreational vehicle 10 via the support bracket assembly 18; and the second end portion 30 of the hand rail assembly 22 is connectable to the step assembly 20 via the connector assembly 24. Thus, when the hand rail assembly 22 is attached to the recreational vehicle 10 and the step assembly 20, the first end portion 26 extend outwardly from the recreational vehicle 10 and is substantially horizontally disposed, the second end portion 30 is substantially normally disposed in a spatial relation with the first end portion 26 so as to be substantially adjacent the step assembly 20, and the medial portion 28 is angularly disposed between the first and second end portions 26, 30 in a downward direction, substantially as shown.

The hand rail assembly can be fabricated of any suitable material and design, provided that the first end portion 26 and the medial portion 28 of the hand rail assembly 22 cooperate to form a hand rail graspable by a person's hand at a convenient height for stabilizing the person as the person exits and enters the recreational vehicle 10 via the door 14 and the steps 16. For example, the first end portion 26 of the hand rail assembly 22 can be fabricated of an elongated tubular member 32 having a first end 34 and an opposed second end 36; the second end portion 30 can fabricated of an elongated tubular member 38 having an upper end portion 40 and a lower portion 42; and the angularly disposed medial portion 28 can be fabricated of an elongated tubular member 44 having a first end 46 and an opposed second end 48. Thus, in an assembled position the upper end portion 40 of the elongated tubular member 38 forming the second end portion 30 of the hand rail assembly 22 is disposed in a spatial relationship with the opposed second end 36 of the elongated tubular member 32 forming the first end portion 26 of the hand rail assembly 22 and at a distance below the elongated axis of the first elongated tubular member 32.

The elongated tubular member 44 forming the angularly disposed medial portion 28 of the hand rail assembly 22 is positioned between and connected to the elongated tubular member 32 and 38. That is, the first end 46 of the elongated tubular member 44 is connected to the opposed second end 36 of the elongated tubular member 32, and the opposed second end 48 of the elongated tubular member 44 is connected to the upper end portion 40 of the elongated tubular member 38 so to provide the hand rail with a suitable configuration for grasping by a person's hand at a convenient height to stabilize the person as heretofore described.

Any suitable means can be utilized for connecting the elongated tubular members 32, 38 and 44 to form the hand rail assembly 22, such as welding and the like. Further, for aesthetic reasons and to alert a person utilizing the hand rail assembly 22 of the termination of the hand rail, the opposed second end 48 of the elongated tubular member 44 is desirably connected to the upper end portion 40 of the elongated tubular member 38 a distance 50 from the upward most end of the elongated tubular member 38 so as to provide a stop at the junction of the elongated tubular members 38 and 44. In addition, for aesthetic purposes, a decorative cap member 51 can be secured to the elongated tubular members 38, 44 substantially as shown.

In order to provide structural strength to the hand rail assembly 22, as well as for aesthetic reasons, it is desirable that the hand rail assembly 22 further comprises an elongated tubular member 52 having a first end 54 and an opposed second end 56, and an elongated tubular 58 having a first end 60 and an opposed second end 62. The elongated tubular member 52 is identical in construction to the elongated tubular member 32 and is positioned in a substantially parallel, spatial relationship with the elongated tubular member 32 substantially as shown. Similarly, the elongated tubular member 58 is identical in construction to the elongated tubular member 44 and is disposed in a substantially parallel, spatial relationship with the elongated tubular member 44 substantially as shown. Thus, the first end 54 of the elongated tubular member 52 is connectable to the recreational vehicle 10 via the support bracket assembly 18; and the opposed second end 56 of the elongated tubular member 52 is connected to the first end 60 of the elongated tubular member 58. The opposed second end 62 of the elongated tubular member 58 is connected to the elongated tubular member 38.

A support member 64 is disposed between and connected to the elongated tubular members 32, 52 so as to be substantially adjacent their respectively opposed second ends 36, 56; and a plurality of support members 66 are disposed between and connected to the elongated tubular members 44, 58. Thus, the elongated tubular members 32, 52 forming the first end portion 26 of the hand rail assembly 22, and the elongated tubular members 44, 58 forming the angularly disposed medial portion 28 of the hand rail assembly 22, in combination with the support members 64, 66 provide additional structural strength to the hand rail assembly 22, while at the same time providing a lattice or decorative design to the hand rail assembly 22.

As previously stated, the first end portion 26 of the hand rail assembly 22 and the second end portion 30 of the hand rail assembly 22 are fabricated of tubular members. Thus, the first end portion 26 can be readily connectable to the recreational vehicle 10 via the support bracket assembly 18; and the second end portion 30 of the hand rail assembly 22 can be readily connectable to the step assembly 20 via the connector assembly 24 as will hereinafter be described in detail.

In order to selectively connect the first end 34 of the elongated tubular member 32 and the first end 54 of the elongated tubular member 52 to the recreational vehicle 10 via the support bracket assembly 18, each of the elongated tubular members 32, 52 are provided with an aperture (not shown) in their respective first ends 34, 54 adapted to receive a securing or locking member, such as a pin or bolt 67 shown in FIG. 2B. It should be understood that the bolt 67 extends through the support bracket assembly 18 and selectively engages the first ends 34, 54 of the elongated tubular members 32, 52, respectively, so that the first end portion 26 of the hand rail assembly 22 is connected to the recreational vehicle 10 via the union of the elongated tubular members 32, 52 with the support bracket assembly 18.

Similarly, the lower end portion 42 of the elongated tubular member 38 of the hand rail assembly 22, which is also desirably of tubular construction, is provided with a threaded aperture (not shown) adapted to receive a connecting or locking member, such as bolt 68, which functions as a lock assembly for securing the elongated tubular member 38 of the hand rail assembly 22 to the connector assembly 24 at a selected vertically extended height with respect to the step assembly 20.

Referring now to FIGS. 1 and 3, the step assembly 20 of the balustrade and platform assembly 12, comprises a frame 70, a floor member 72 connected to and supported by the frame 70, and a plurality of leg assemblies 74 connected to the frame 70 for stabilizing the frame 70, and thus the floor member 72, in substantially horizontally disposed position a predetermined distance from the ground or supporting surface. Each of the leg assemblies 74 is adjustable in length independent of the other leg assemblies so that the frame 70, and thus the floor member 72, is maintained in a substantially horizontally disposed position regardless of the slope or terrain of the supporting ground or surface.

The frame 70 is fabricated of a plurality of elongated members, such as elongated members 76, 78, 80 and 82 which are connected at their adjacent end portions to one of the leg assemblies 74 substantially as shown. If desired, additional elongated members can be disposed between opposed elongated members, such as the elongated members 76, 80, for providing structural strength to the frame 70 and the floor member 72.

The leg assemblies 74 are identically constructed, but are designed so that each of the leg assemblies 74 can be selectively adjusted in height independently of the adjacent leg assemblies 74. Thus, the leg assemblies 74, in combination with the connector assembly 24, provides the step assembly 20 and the hand rail assembly 22 with a range of adjustments to compensate for the terrain and positioning of the step assembly 20, including lateral, rotational and vertical adjustments.

Figure 4:
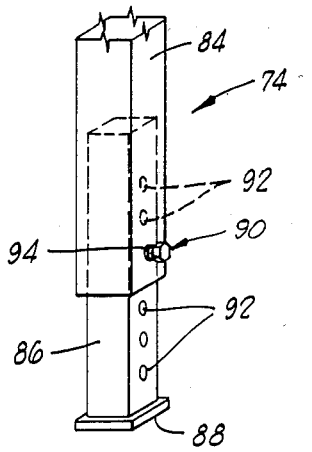
FIG. 4 is an isometric view of an adjustable leg assembly of the portable balustrade and platform assembly of the present invention, and illustrating the vertical adjustment of the leg assembly.

Referring now to FIGS. 1, 3 and 4, each of the leg assemblies 74 of the step assembly 20 comprises a tubular housing member 84 connected to the frame 70 so as to be substantially normally disposed to the plane of the floor member 72, and thus the elongated members 76, 78, 80 and 82 forming the frame 70. A leg member 86 is telescopically positioned in the tubular housing member 84; and a support foot member 88, having a substantially planar lower surface, is connected to a distal end of the leg member 86 for supportingly engaging the ground and stabilizing the step assembly 20.

As previously stated, the leg member 86, which is telescopically positioned in the tubular housing member 84 provides vertical adjustments of one of the leg members 86 independent of the adjustment of the other leg members 86 of the leg assemblies 74. Thus, the leg assemblies 74 further comprises a leg connector or leg locking member 90 for securing the leg member 86 in its tubular housing member 84 at a selected extension length.

Any suitable means can be employed as the leg connector member 90. For example, the tubular housing member 84 of each of the leg assemblies 74 can be provided with aligned apertures in two opposed sidewalls thereof (not shown); and the leg member 86 of each of the leg assemblies 74 can provided with a plurality of apertures in two opposed sidewalls thereof, such as apertures 92. Each of the apertures in one sidewall of the leg member 86 is alignable with an aperture in the opposed sidewall thereof, and the aligned apertures are selective alignable with the apertures (not shown) in the tubular housing member 84 when the leg member 86 is positioned within the tubular housing member 84 substantially as shown. In order to secure the leg member 86 within the tubular housing member 84 at a desired length, a pin member 94 is positionable through the aligned apertures (not shown) of the tubular housing member 84 and the aligned apertures 92 of the leg member.

As shown in FIG. 1, the lower end portion 42 of the elongated tubular member 38 of the hand rail assembly 22 is connected to the step assembly 20 via the connector assembly 24. The interconnection of the elongated tubular member 38 of the hand rail assembly 22 to the step assembly 20 via the connector assembly 24 provides lateral, rotational and vertical adjustments of the hand rail assembly 22 relative to the step assembly 20. Thus, the connector assembly 24, in combination with the independent vertical adjustment provided each of the leg members 86 of the leg assemblies 74, permits one to maintain the floor member 72 of the step assembly 20 in substantially horizontal position regardless of the terrain of the ground or foundation supporting the recreational vehicle 10 and the step assembly 20.

Referring now to FIGS. 1 and 3, the connector assembly 24 comprises a connector housing 96 having a bore 97 extending therethrough. The connector housing 96 is connected to two of the elongated members forming the frame 70, such as the elongated members 76, 82. To stabilize the connector housing 96 relative to the frame 70, a spacer member 98 is disposed adjacent and connected to an interior surface of the elongated member 76 substantially as shown in FIG. 3.

In order to provide the desired versatility to the step assembly 20 so that the hand rail assembly 22 can be readily moved from one side of the step assembly 20 to the other side of the step assembly 20 for use by a person having an impaired arm, a second connector housing 100 is connected to the frame 70 via a space member 101 so as to be aligned with the connector housing 96. The second connector housing 100 is identical in construction to the connector housing 96. Thus, only connector housing 96, and the connection of the lower end portion 42 of the elongated tubular member 38 of the hand rail assembly 22 to the step assembly 20 via the connector assembly 24, and thus the connector housing 96, will be described in detail.

The connector assembly 24 further comprises: a first leg member 102 positionable within the connector housing 96; a second leg member 104 positionable within the lower end portion 42 of the elongated tubular member 38 forming the second end portion 30 of the hand rail assembly 22; and, a pivot pin 106 for pivotally connecting the first leg member 102 to the second leg member 104 such that the second leg member 104 is pivotally movable in a direction indicated by the arrows 108, 110 of FIG. 3.

The first leg member 102 is secured within the connector housing 96 via a locking member, such as bolt 112 disposed through a threaded aperture (not shown) in the connector housing 96. The bolt 112 selectively engages the first leg member 102 for securing and locking the first leg member 102 in the connector housing 96 at the desired extended lateral length and rotational direction. That is, the first leg member 102 can be slidably positioned within the connector housing 96 by selectively moving the first leg member 102 in the direction indicated by the arrows 114, 116 (FIG. 3) so that the second leg member 104, when secured in the selected angularly disposed position (as indicated by the movement of the second leg member 104 in the direction of the arrows 108, 110 (FIG. 3) is aligned with and positionable within the lower end portion 42 of the elongated tubular member 38 of the hand rail assembly 22.

The second leg member 104 of the connector assembly 24 is secured in the lower end portion 42 of the elongated tubular member 38 via a locking member, such as the bolt 68 disposed through a threaded aperture (not shown) in the elongated tubular member 38. Thus, the vertical adjustment of the hand rail assembly 22 relative to the step assembly 20 can be achieved by selectively moving the elongated tubular member 38 along the second leg member 104 in a selected direction indicated by the arrows 120, 122, and thereafter securing the elongated tubular member 38 to the second leg member 104 via the bolt 68 as shown. The vertical adjustment of the hand rail assembly 22 relative to the step assembly 20 via the connector assembly 24 insures proper connection between the hand rail assembly 22 and the step assembly 20, and the hand rail assembly 22 to the support bracket assembly 18.

Figure 5:
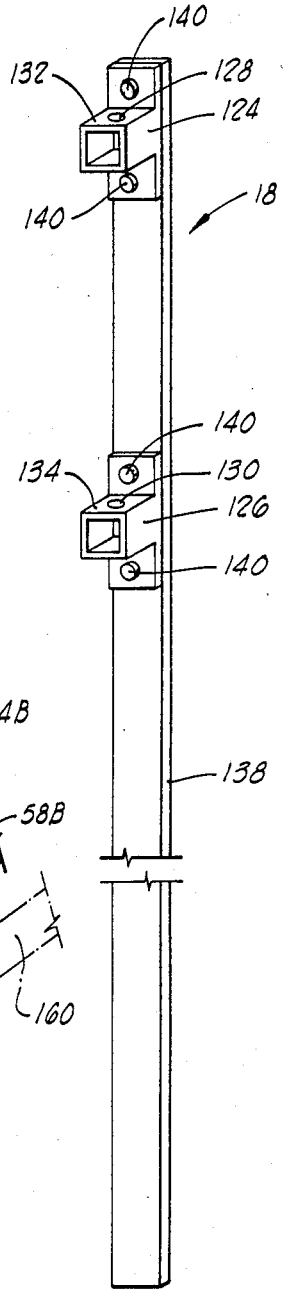
FIG. 5 is an isometric view of a support bracket connectable to a structure, such as a recreational vehicle, for connecting the hand rail assembly to the structure.

Referring now to FIGS. 1 and 5, the support bracket 18 for connecting the hand rail assembly 22 to the recreational vehicle 10 comprises a female connector member 124 adapted to matingly receive the first end 34 of the elongated tubular member 32 of the hand rail assembly 22; and a female connector 126 adapted to matingly receive the first end 54 of the elongated tubular member 52 of the hand rail assembly 22. The female connector members 124, 126 are connected to the recreational vehicle 10 so as to be substantially vertically aligned for receiving the first end 34 of the elongated tubular member 32 and the first end 54 of the elongated tubular member 52, respectively. The female connector members 124, 126 are each provided with an aperture 128, 130, respectively, in an upper surface 132, 134 thereof. The apertures 128, 130 are alignable with apertures (not shown) disposed in the first ends 34, 54 of the elongated tubular members 32, 52, respectively, of the hand rail assembly 22 so that connecting elements, such as bolts 67 can be disposed therethrough for securing the first end portion 26 of the hand rail assembly 22 to the support bracket assembly 18 substantially as shown in FIG. 1.

In order to structurally strengthen the attachment of the female connector members 124, 126 to the recreational vehicle 10, the support bracket assembly 18 further comprises a substantially vertically disposed elongated strap member 138 connectable to a structural support member (not shown) of the recreational vehicle 10 such that the elongated strap member 138 is disposed substantially parallel, and in close proximity, to a side portion of a frame structure of the door 14 of the recreational vehicle 10. The female connector members 124, 126 can be secured to the elongated strap member 138 by any suitable means, such as with a plurality of bolts 140.

The balustrade and platform assembly 12 hereinbefore described with reference to FIGS. 1–5 provides a portable assembly attachable to a structure, such as the recreational vehicle 10, for assisting a person entering or exiting the door 14 of the recreational vehicle 10 via the steps 16 thereof. Further, the balustrade and platform assembly 12 can readily be disassembled for transporting and storage of same. That is, the hand rail assembly 22 can be disconnected from the support bracket assembly 18 mounted on the recreational vehicle 10, and the step assembly 20 can be detached from the hand rail assembly 22.

Figure 6:
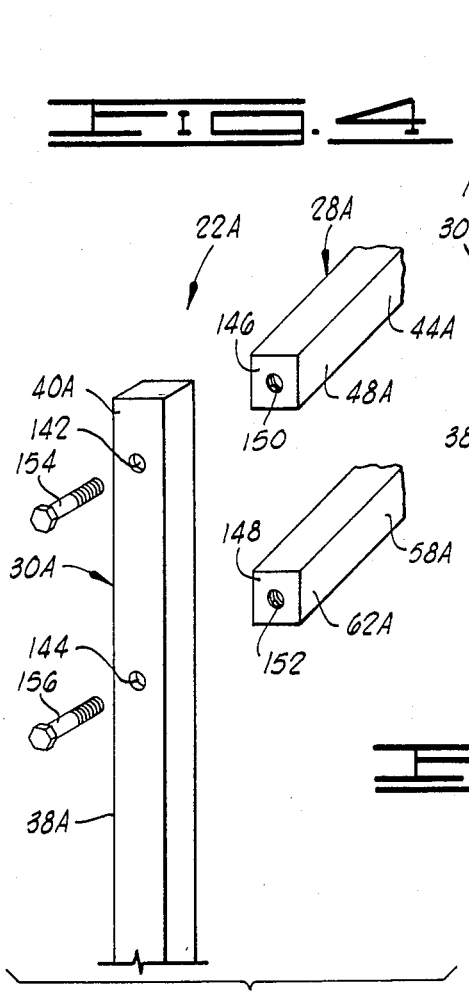
FIG. 6 is an exploded, fragmentary isometric view of the interconnection of elements of the hand rail assembly to facilitate transportation and storage of the balustrade and platform assembly.

In order facilitate the storage and transportation of the balustrade and platform assembly 12, a hand rail assembly 22A for connection to the support bracket 18 and the step assembly 20, via the connector assembly 24, is shown in FIG. 6.

In this embodiment, a second end portion 30A of a hand rail assembly 22A is illustrated as having a plurality of aligned apertures, such as apertures 142 and 144, formed in an upper end portion 40A of an elongated tubular member 38A. An angularly disposed medial portion 28A of the hand rail assembly 22A, i.e., elongated tubular members 44A and 58A are provided with a plate closure member 146, 148, in their respective opposed second ends 48A and 56A. A threaded aperture 150 is provided in the plate member 146 which is alignable with the aperture 142 of the elongated tubular member 38A; and a threaded aperture 152 is provided in the plate member 148 which is alignable with the aperture 144 in the elongated tubular member 38A. Thus, in an assembled position a bolt 154 can be disposed through the aperture 142 in the elongated tubular member 38A for threadingly engaging the threaded aperture 150 in the plate member 146 so as to secure the elongated tubular member 44A to the elongated tubular member 38A; and a bolt 156 can be disposed through the aperture 144 in the elongated tubular member 38A for threadingly engaging the threaded aperture 152 in the plate member 148 so as to secure the elongated tubular member 58A to the elongated tubular member 38A. Thus, the elongated tubular member 38A can be effectively connected to the elongated tubular members 48A and 52A to form the second end portion 30A and the angularly disposed medial portion 28A of the hand rail assembly 22A. Further, by removing the bolts 154, 156 the hand rail assembly 22A can be partially disassembled for storage and transporting of the balustrade and platform assembly 12.

Figure 7:
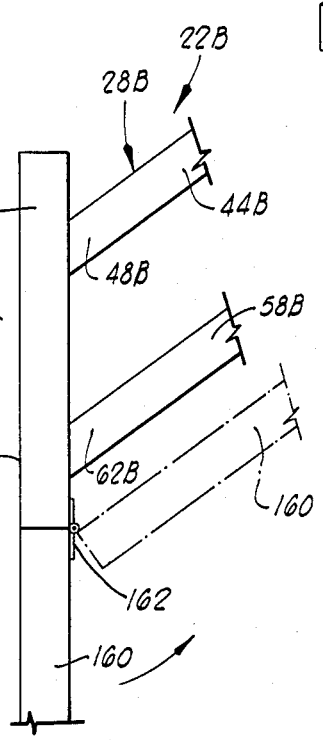
FIG. 7 is a fragmentary, side elevational view of a second embodiment of the interconnection of elements of the hand rail assembly to facilitate transportation and storage of the balustrade and platform assembly.

Referring now to FIG. 7, another embodiment a second end portion 30B of a hand rail assembly 22B is illustrated. In this embodiment an opposed second end 48B of an elongated tubular member 44B is connected to an elongated tubular 38B; and an opposed second end 62 of an elongated tubular member 58B is connected to the elongated tubular member 38B such that the elongated tubular members 44B and 58B are disposed in a substantially parallel, spatial relationship as shown.

The elongated tubular member 38B, which forms the second end portion 30B of a hand rail assembly 22B of the balustrade and platform assembly 12 is characterized as having an upper portion 158 and a lower portion 160. The lower portion 160 is connectable to the connector assembly 24 of the balustrade and platform assembly 12 as hereinbefore described with reference to FIGS. 1–5 of the drawings. However, to facilitate transportion and storage of the balustrade and platform 12, especially when same is in a disassembled position, the upper and lower portions 158, 160 of the elongated tubular member 38B are connected by a hinge assembly, such as hinge element 162. Thus, the elongated tubular members 38B forming the second end portion 30B of the hand rail assembly 22B is selectively positionable in one of an extended first position (wherein the upper portion 158 abutts and is aligned with the lower portion 160 as shown), and a second position (wherein the lower portion 162 is positioned below and substantially parallel to the elongated tubular member 58B of the angularly disposed medial portion 28B of the hand rail assembly 22B as indicated by phantom lines) for transportation and storage.

The balustrade and platform assembly 10 of the present invention can readily be attached to a structure, such as the recreational vehicle 10, for use; or the balustrade and platform assembly 10 can be easily disassembled by disconnecting the hand rail assembly 22 from the support bracket assembly 18 and the step assembly 20 for storage or transporting of the balustrade and platform assembly 10 when the recreational vehicle 10 is being moved from one location to another. Further, while a majority of the components of the balustrade and platform assembly 10 have been described as being fabricated of tubular materials, it should be understood that other types of equivalent material can be employed in the fabrication of the balustrade and platform assembly 10 without departing from the spirit of the inventive concept, provided, however, that the use of such materials permits the angular and spatial relationship of the hand rail assembly 22 with the support bracket assembly 18 and the step assembly 20 via the connector assembly 24 to be established over a range of adjustments, including lateral, rotational and vertical adjustments.

It is clear that the present invention is well adapted to carry out the objects and to attain the ends and advantages mentioned as well as those inherent therein. While presently preferred embodiments of the invention have been described for purposes of this disclosure, numerous changes may be made which will readily suggest themselves to those skilled in the art and which are accomplished within the spirit of the invention disclosed and as defined in the appended claims.

What is claimed is:

1. A detachable balustrade and platform assembly for a recreational vehicle adapted to stabilize and assist a person entering and exiting the recreational vehicle via a door thereof, comprising:

a support bracket connectable to the recreational vehicle substantially adjacent the door thereof;

a step assembly supported on the ground, the step assembly having a substantially horizontally disposed planar supporting surface;

hand rail means graspable by the person for stabilizing the person as the person exits and enters the recreational vehicle via the door thereof to and from the step assembly, the hand rail means having a first end portion and a second end portion, the first end portion connectable to the support bracket such that the second end portion is disposed substantially adjacent the step assembly; and first connector means for connecting the second end portion of the hand rail means to the step assembly such that the angular and spatial relationship of the hand rail means between the support bracket and the step assembly can be established over a range of adjustments including lateral, rotational and vertical adjustments.

2. The detachable balustrade and platform assembly of claim 1 wherein the first connector means comprises:

at least one connector housing having a bore extending therethrough, the connector housing connected to the step assembly so as to be substantially alignable with the support bracket;

a first leg member positionable within the bore of the connector housing;

a second leg member connectable to the second end portion of the hand rail means;

pivot means for connecting the first leg member and the second leg member such that the second leg member is pivotally movable in a direction along a longitudinal axis of the first leg member, the pivot means adapted to secure the first and second leg members in a selected angularly disposed position;

first lock means for connecting the first leg member in the connector housing at a selected laterally extended length and rotational direction; and second lock means for securing the second leg member to the second end portion of the hand rail means at a selected vertically extended length.

3. The detachable balustrade and platform assembly of claim 2 wherein the step assembly comprises:

a frame;

a floor member connected to the frame; and a plurality of leg means connected to the frame for stabilizing the frame in a substantially horizontally disposed position a predetermined distance from the ground, each of the leg means adjustable in length independent of the other leg means so that the frame is maintained in the substantially horizontally disposed position regardless of the terrain of the supporting ground.

4. The detachable balustrade and platform assembly of claim 3 wherein each of the leg means comprises:

a tubular housing member connected to the frame so as to be substantially normally disposed to the floor member;

a leg member telescopically disposed in the tubular housing member; and leg connector means for connecting the leg member in its tubular housing member at a selected extension length.

5. The detachable balustrade and platform assembly of claim 4 wherein the support bracket comprises:

at least one female coupling member connected to to the recreational vehicle, the female coupling member adapted to matingly receive the first end portion of the hand rail means so as to connect the hand rail means to the recreational vehicle.

6. The detachable balustrade and platform assembly of claim 5 wherein the hand rail means comprises:

at least one first elongated member having a first end and an opposed second end, the first end thereof connectable to the female coupling member of the support bracket such that the first elongated member extends outwardly from the recreational vehicle and is substantially horizontally disposed;

a second elongated member having an upper end portion and a lower end portion, the second elongated member being disposed substantially normal and in a spatial relationship with the first elongated member such that the upper end portion of the second elongated member is disposed a distance below the first elongated member, the lower end portion of the second elongated member being disposed substantially adjacent the frame of the step assembly and connected thereof via the first connector means; and at least one third elongated member having a first end and an opposed second end, the first end thereof connected to the second end of the first elongated member and the opposed second end thereof connected to the upper end portion of the second elongated member such that the the third elongated member is angularly disposed between the first and second elongated members and the first and third elongated member cooperate to form a hand rail.

7. The detachable balustrade and platform assembly of claim 6 wherein the support bracket further comprises a substantially vertically disposed elongated strap member connectable to a structural support member of the recreational vehicle such that the elongated strap member is disposed substantially parallel to and in close proximity to a side portion of a frame structure of the door of the recreational vehicle; and wherein the female coupling member of the support bracket is supported by the strap member.

8. The detachable balustrade and platform assembly of claim 7 wherein the tubular housing member of each of the leg means is provided with an aperture in two opposed side walls thereof, the apertures being aligned one with the other, the leg member of each of the leg means is provided with a plurality of apertures in two opposed side walls thereof, each of the apertures in one side wall being alignable with an aperture in the opposed side wall and selectively alignable with the apertures in the tubular housing member when the leg member is disposed within the tubular housing member, and wherein the leg connector means further comprises:

a pin member positionable through the aligned apertures of the tubular housing member and the leg member to secure the leg member at the selected extension.

9. The detachable balustrade and platform assembly of claim 8 wherein each of the leg means further comprises:

a support foot member having a substantially planar lower surface, the support foot member connected to a distal end of the leg member for supportingly engaging the ground.

10. The detachable balustrade and platform assembly of claim 9 wherein the hand rail means further comprises:

second connector means for detachably connecting the second elongated member to the third elongated member.

11. The detachable balustrade and platform assembly of claim 9 wherein the second elongated member is fabricated of an upper section and a lower section, and wherein the hand rail means further comprises:

hinge means for connecting the upper and lower sections such that the lower section is positionable in one of a first position and a second position, in the first position the lower section being aligned with the upper section for attachment to the second leg member of the first connector means, in the second position the lower section being disposed in a position below and substantially parallel to the third elongated member for storage and transportation.

12. A portable balustrade and platform assembly which is detachably connectable to a structure having an elevated door entrance comprising:

step means for providing at least one a substantially horizontal step surface disposable at a predetermined height above the foundation surface of the structure substantially below the door entrance;

hand rail means for providing a hand rail at a convenient height to a person entering or leaving the structure;

bracket means attachable to the structure for connecting one end of the hand rail means to the structure at a position near the door entrance; and first connector means supported by the step means for connecting the opposing end of the hand rail means to the step means, the connector means interconnecting the opposing end at a selected angular and spatial disposition including lateral, rotational and vertical adjustments thereof.

13. The portable balustrade and platform assembly of claim 12 wherein the step means comprises:

a frame;

a floor member connected to the frame; and a plurality of leg means connected to the frame for stabilizing the frame in a substantially horizontally disposed position a predetermined distance from the foundation surface, each of the leg means adjustable in length independent of the other leg means so that the frame is maintained in the substantially horizontally disposed position regardless of the terrain of the foundation surface.

14. The detachable balustrade and platform assembly of claim 13 wherein the first connector means comprises:

at least one connector housing having a bore extending therethrough, the connector housing connected to the frame so as to be substantially alignable with the support bracket means;

a first leg member positionable within the bore of the connector housing;

a second leg member connectable to the opposing end of the hand rail means;

pivot means for connecting the first leg member and the second leg member such that the second leg member is pivotally movable in a direction along a longitudinal axis of the first leg member, the pivot means adapted to secure the first and second leg members in a selected angularly disposed position;

first lock means for connecting the first leg member in the connector housing at a selected laterally extended length and rotational direction; and second lock means for securing the second leg member to the opposing end of the hand rail means at a selected vertically extended length.

15. The portable balustrade and platform assembly of claim 14 wherein the bracket means comprises:

at least one female coupling member connected to to the structure the female coupling member adapted to matingly receive the one end of the hand rail means so as to connect the hand rail means to the strucuture.

16. The detachable balustrade and platform assembly of claim 15 wherein the hand rail means comprises:

at least one first elongated member having a first end and an opposed second end, the first end thereof connectable to the female coupling member of the support bracket such that the first elongated member extends outwardly from the structure and is substantially horizontally disposed;

a second elongated member having an upper end portion and a lower end portion, the second elongated member being disposed substantially normal and in a spatial relationship with the first elongated member such that the upper end portion of the second elongated member is disposed a distance below the first elongated member, the lower end portion of the second elongated member being disposed substantially adjacent the frame of the step assembly and connected thereof via the first connector means; and at least one third elongated member having a first end and an opposed second end, the first end thereof connected to the second end of the first elongated member and the opposed second end thereof connected to the upper end portion of the second elongated member such that the the third elongated member is angularly disposed between the first and second elongated members and the first and third elongated member cooperate to form a hand rail.

17. The portable balustrade and platform assembly of claim 15 wherein each of the leg means comprises:

a tubular housing member connected to the frame so as to be substantially normally disposed to the floor member;

a leg member telescopically disposed in the tubular housing member; and leg connector means for connecting the leg member in its tubular housing member at a selected extension length.

18. The detachable balustrade and platform assembly of claim 17 wherein each of the leg means further comprises:

a support foot member having a substantially planar lower surface, the support foot member connected to a distal end of the leg member for supportingly engaging the ground.

19. The portable balustrade and platform assembly of claim 15 wherein the support bracket further comprises a substantially vertically disposed elongated strap member connectable to a structural support member of the structure such that the elongated strap member is disposed substantially parallel to and in close proximity to a side portion of a frame structure of the door of the structure; and wherein the female coupling member of the support bracket is supported by the strap member.

20. The portable balustrade and platform assembly of claim 16 wherein the hand rail means further comprises:

second connector means for detachably connecting the second elongated member to the third elongated member.

21. The portable balustrade and platform assembly of claim 16 wherein the second elongated member is fabricated of an upper section and a lower section, and wherein the hand rail means further comprises:

hinge means for connecting the upper and lower sections such that the lower section is positionable in one of a first position and a second position, in the first position the lower section being aligned with and forming an extension of the upper section for attachment to the second leg member of the first connector means, in the second position the lower section being disposed in a position below and substantially parallel to the third elongated member for storage and transportation.

* * * * *